US009837084B2

(12) United States Patent
Chen et al.

(10) Patent No.: US 9,837,084 B2
(45) Date of Patent: Dec. 5, 2017

(54) STREAMING ENCODER, PROSODY INFORMATION ENCODING DEVICE, PROSODY-ANALYZING DEVICE, AND DEVICE AND METHOD FOR SPEECH SYNTHESIZING

(71) Applicant: National Chiao Tung University, Hsinchu (TW)

(72) Inventors: Sin-Horng Chen, Hsinchu (TW); Yih-Ru Wang, Hsinchu (TW); Chen-Yu Chiang, Hsinchu (TW); Chiao-Hua Hsieh, Hsinchu (TW)

(73) Assignee: NATIONAL CHAO TUNG UNIVERSITY, Hsinchu (TW)

( * ) Notice: Subject to any disclaimer, the term of this patent is extended or adjusted under 35 U.S.C. 154(b) by 683 days.

(21) Appl. No.: 14/168,756

(22) Filed: Jan. 30, 2014

(65) Prior Publication Data

US 2014/0222421 A1 Aug. 7, 2014

(30) Foreign Application Priority Data

Feb. 5, 2013 (TW) ..... 102104478 A

(51) Int. Cl.
*G10L 19/18* (2013.01)
*G10L 19/00* (2013.01)
(Continued)

(52) U.S. Cl.
CPC ..... *G10L 19/0018* (2013.01); *G10L 13/02* (2013.01); *G10L 13/10* (2013.01); *G10L 19/0019* (2013.01)

(58) Field of Classification Search
CPC ..... G10L 19/0018
See application file for complete search history.

(56) References Cited

U.S. PATENT DOCUMENTS 6,161,091 A * 12/2000 Akamine ..... G10L 19/0018 704/207
6,502,073 B1 * 12/2002 Guan ..... G10L 19/0018 704/235
(Continued)

FOREIGN PATENT DOCUMENTS

TW I350521 10/2011

OTHER PUBLICATIONS

Burnett, Daniel C., Andrew Hunt, and Mark R. Walker. "Speech Synthesis Markup Language (SSML) Version." WC Recommendation. W C. uRL: http://www. w3. org/TR/2004/REC-speech-synthesis-20040907/(cit. on p.) (1999).*
(Continued)

*Primary Examiner* — Douglas Godbold
(74) *Attorney, Agent, or Firm* — Volpe and Koenig, P.C.

(57) ABSTRACT

A speech-synthesizing device includes a hierarchical prosodic module, a prosody-analyzing device, and a prosody-synthesizing unit. The hierarchical prosodic module generates at least a first hierarchical prosodic model. The prosody-analyzing device receives a low-level linguistic feature, a high-level linguistic feature and a first prosodic feature, and generates at least a prosodic tag based on the low-level linguistic feature, the high-level linguistic feature, the first prosodic feature and the first hierarchical prosodic model. The prosody-synthesizing unit synthesizes a second prosodic feature based on the hierarchical prosodic module, the low-level linguistic feature and the prosodic tag.

8 Claims, 7 Drawing Sheets

(51) Int. Cl.
*G10L 13/02* (2013.01)
*G10L 13/10* (2013.01)

(56) References Cited

U.S. PATENT DOCUMENTS

| | | | | |
|---|---|---|---|---|
| 6,873,953 | B1 * | 3/2005 | Lennig | G10L 25/87 704/248 |
| 6,961,704 | B1 * | 11/2005 | Phillips | G10L 13/10 704/267 |
| 7,069,216 | B2 * | 6/2006 | DeMoortel | G10L 13/10 704/260 |
| 2006/0235685 | A1 * | 10/2006 | Nurminen | G10L 13/033 704/235 |
| 2009/0055158 | A1 * | 2/2009 | Xu | G06F 17/289 704/2 |
| 2010/0076761 | A1 * | 3/2010 | Juergen | G10L 15/197 704/235 |
| 2011/0099019 | A1 * | 4/2011 | Zopf | G10L 17/00 704/500 |
| 2011/0184721 | A1 * | 7/2011 | Subramanian | G10L 19/0018 704/4 |
| 2012/0016674 | A1 * | 1/2012 | Basson | G10L 19/0018 704/258 |

OTHER PUBLICATIONS

Office Action issued in corresponding Taiwanese Patent Application No. 10420245220 dated Feb. 25, 2015, consisting of 6 pp.

* cited by examiner

STREAMING ENCODER, PROSODY INFORMATION ENCODING DEVICE, PROSODY-ANALYZING DEVICE, AND DEVICE AND METHOD FOR SPEECH SYNTHESIZING

CROSS-REFERENCE TO RELATED APPLICATION AND CLAIM OF PRIORITY

The application claims the benefit of Taiwan Patent Application No. 102104478, filed on Feb. 5, 2013, in the Taiwan Intellectual Property Office, the disclosures of which are incorporated herein in their entirety by reference.

FIELD OF THE INVENTION

The present invention relates to a speech-synthesizing device, and more particularly to a streaming encoder, prosody information encoding device, prosody-analyzing device and device and method for speech synthesizing.

BACKGROUND OF THE INVENTION

In the traditional segment-based speech coding, the messages of prosody corresponding to speech segments are usually directly encoded with quantitative methods over prosodic features, without considering the use of prosodic model with linguistic meanings for performing parameterized prosody coding. Some methods of the mentioned traditional speech coding are performed with the corresponding duration and speech pitch contour of the phonemes in the syllables. The coding is to use pre-stored representative duration and grouping templates of pitch contour of the phonemes in the syllables as the duration and the pitch contour of the phonemes in the syllables, but not consider the prosody generating model. The coded speech with the mentioned method is hard to be applied to prosodic transformation thereto.

Coding to pitch contour is to use the linear segments of the pitch contour to represent the values thereof. The messages of the pitch contour are represented with the slope as well as endpoint values of those linear segments. Representative linear segment templates are stored in a codebook, which is used for the coding to pitch contour. The method is simple, but without considering the prosody generating model. The coded speech with the mentioned method is hard to be applied to prosodic transformation thereto.

There is a method of scalar quantization to the pitch contour of phoneme, which is to use the average pitch and the slope of the phoneme to represent the pitch contour of the phoneme, and to perform scalar quantization to the average pitch and the slope of the phrase, which does not consider the prosody generating model. The coded speech with the mentioned method of scalar quantization is hard to be applied to prosodic transformation thereto.

Another method is to normalize the duration and the average pitch of phoneme by subtracting the average duration and average pitch contour of the corresponding phoneme type from observed value of the duration and the pitch contour and finally performing scalar quantization to the normalized phoneme duration and the pitch contour. Such a method may reduce the transmission data rate. Doing without considering the prosody generating model, the coded speech with the mentioned method is hard to be applied to prosodic transformation thereto.

One another method is to segment the speech into segments of different number of frames, each of which has a pitch contour represented by the average pitch of the frame, while an energy contour is represented with vector quantization, without considering the prosody generating model. The coded speech with the mentioned method is hard to be applied to prosodic transformation thereto.

There is also a method of piecewise linear approximation (PLA) for use to represent the pitch. The PLA information includes the pitch value and time information of the endpoints of the segment and the pitch value and time information of the critical points. Some articles introduce scalar quantization for representing those messages, while use vector quantization for representing the PLA information. Some articles introduce traditional method of frame-based speech coder, which performs quantization to the pitch information of each frame and may accurately indicate the pitch information, but suffers high data rate.

Some articles introduce the method of quantizing the pitch contour of a segment with pitch contour templates stored in the codebook and encoding the templates. The method may encode the pitch information with very low data rate, but with higher distortion.

The encoding process of the prior arts can be summarized as below: (1) segmentation of the speech into segments; and (2) encoding of the spectrum and the prosodic information of the segments. Usually, for one segment, the corresponding phoneme, syllable or the acoustic unit defined by the system can be obtained. The segmentation can be performed by automatic speech recognition or can be done by forced alignment given known phoneme, syllable or the acoustic unit defined by the system. Then, each segment is encoded with the spectrum information and prosodic message thereof.

On the other hand, the reconstruction of the encoded speech by the segment-based speech encoder includes the following steps: (1) decoding and reconstruction of the spectrum and prosodic information; and (2) speech synthesis.

Most of the prior art technologies pay more attention on the encoding of spectrum information, but less on the aspect of the encoding of prosodic information. The prior art often encodes the prosodic information by means of quantization, without considering the model behind the prosodic information, and therefore hard to obtained lower encoding data rate and to perform speech transformation for the encoded speech by systematic methods.

In order to overcome the drawbacks in the prior art, a speech-synthesizing device, and more particularly to a streaming encoder, prosody information encoding device, prosody-analyzing device and device and method for speech synthesizing is provided. The novel design in the present invention not only solves the problems described above, but also is easy to be implemented. Thus, the present invention has the utility for the industry.

SUMMARY OF THE INVENTION

In accordance with one aspect of the present invention, a speech-synthesizing device is provided. The speech-synthesizing device includes a hierarchical prosodic module, a prosody-analyzing device, and a prosody-synthesizing unit. The hierarchical prosodic module generates at least a first hierarchical prosodic model. The prosody-analyzing device receives a low-level linguistic feature, a high-level linguistic feature and a first prosodic feature, and generates at least a prosodic tag based on the low-level linguistic feature, the high-level linguistic feature, the first prosodic feature and the first hierarchical prosodic model. The prosody-synthesizing unit synthesizes a second prosodic feature based on the hierarchical prosodic module, the low-level linguistic feature and the prosodic tag.

In accordance with a further aspect of the present invention, a prosodic information encoding apparatus is provided. The prosodic information encoding apparatus includes a speech segmentation and prosodic feature extracting device, a prosodic structure analysis unit and an encoder. The speech segmentation and prosodic feature extracting device receives an input speech and a low-level linguistic feature to generate a first prosodic feature. The prosodic structure analysis unit receives the first prosodic feature, the low-level linguistic feature and a high-level linguistic feature, and generates a prosodic tag based on the first prosodic feature, the low-level linguistic feature and the high-level linguistic feature. The encoder receives the prosodic tag and the low-level linguistic feature to generate a code stream.

In accordance with a further aspect of the present invention, a code stream generating apparatus is provided. The code stream generating apparatus comprises a prosodic feature extractor, a hierarchical prosodic module and an encoder. The prosodic feature extractor generates a first prosodic feature. The hierarchical prosodic module provides a prosodic structure meaning for the first prosodic feature. The encoder generates a code stream based on the first prosodic feature having the prosodic structure meaning. The hierarchical prosodic module has at least two parameters being ones selected from the group consisting of a syllable duration, a syllable pitch contour, a pause timing, a pause frequency, a pause duration and a combination thereof.

In accordance with a further aspect of the present invention, a method for synthesizing a speech is provided. The method comprises steps of providing a hierarchical prosodic module, a low-level linguistic feature, a high-level linguistic feature and a first prosodic feature; generating at least a prosodic tag based on the low-level linguistic feature, the high-level linguistic feature, the first prosodic feature and the hierarchical prosodic module; and outputting the speech according to the prosodic tag.

In accordance with a further aspect of the present invention, a prosodic structure analysis unit is provided. The prosodic structure analysis unit comprises a first input terminal, a second input terminal, a third input terminal and an output terminal. The first input terminal receives a first prosodic feature. The second input terminal receives a low-level linguistic feature. The third input terminal receives a high-level linguistic feature. The prosodic structure analysis unit generates a prosodic tag at the output terminal based on the first prosodic feature, the low-level and the high-level linguistic features.

In accordance with further another aspect of the present invention, a prosodic structure analysis apparatus is provided. The prosodic structure analysis apparatus includes a hierarchical prosodic module and a prosodic structure analysis unit. The hierarchical prosodic module generates a hierarchical prosodic model. The prosodic structure analysis unit receives a first prosodic feature, a low-level linguistic feature and a high-level linguistic feature, and generates a prosodic tag based on the first prosodic feature, the low-level and the high-level linguistic features and the hierarchical prosodic model.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
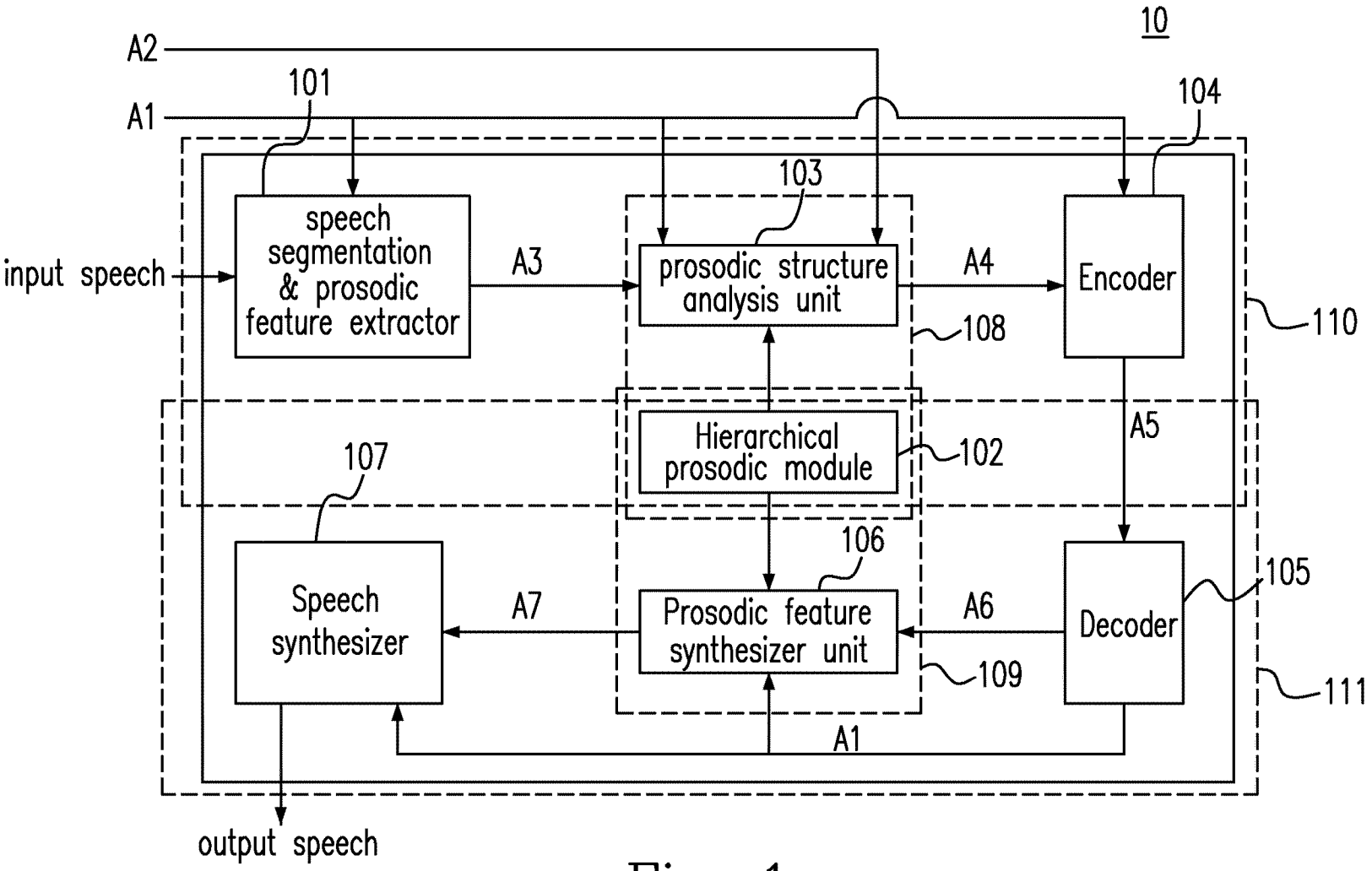
FIG. 1 is a schematic diagram showing a speech-synthesizing apparatus according to one embodiment of the present invention.

To achieve the aforementioned objective, the present invention employs a hierarchical prosodic module in a prosody encoding apparatus whose block diagram is shown in FIG. 1. Referring to FIG. 1, the speech-synthesizing apparatus 10 includes a speech segmentation and prosodic feature extractor 101, a hierarchical prosodic module 102, a prosodic structure analysis unit 103, an encoder 104, a decoder 105, a prosodic feature synthesizer unit 106, a speech synthesizer 107, a prosodic structure analysis device 108, a prosodic feature synthesizer device 109, a prosodic message encoding device 110 and a prosodic message decoding device 111.

Basic concepts of the present invention are set forth as below: Firstly, inputting a speech signal and its corresponding low-level linguistic feature A1 into the speech segmentation and prosodic feature extractor 101, so as to perform syllable boundary division to the input speech utilizing acoustic model and obtain syllable prosodic features for the use by the next prosodic structure analysis unit 103.

The main usage of the hierarchical prosodic module 102 is to describe prosodic hierarchical structure of Mandarin Chinese, including syllable prosodic-acoustic model, syllable juncture prosodic-acoustic model, prosodic state model, and break-syntax model.

The main usage of the prosodic structure analysis unit 103 is to take advantage of the hierarchical prosodic module 102 to analyze the prosodic feature A3, which is generated by the speech segmentation and prosodic feature extractor 101, and then to represent the speech prosody by prosodic structures in terms of prosodic tags.

The main function of the encoder 104 is to perform encoding to the messages necessary for the reconstruction of speech prosody and bit streaming. Those messages include the prosodic tag A4 generated by the prosodic structure analysis unit 103 and the input low-level linguistic feature A1.

The main functions of the decoder 105 include decoding the bit stream A5 and decoding the prosodic tag A6 required by the prosodic feature synthesizer unit 106 and the low-level linguistic feature A1.

The main function of the prosodic feature synthesizer unit 106 is to make use of the decoded prosodic tag A6 and the low-level linguistic feature A1 to synthesize and reconstruct the speech prosodic feature A7, with the input from the hierarchical prosodic module 102 as side information.

The main function of the speech synthesizer 107 is to synthesize the speech with the reconstructed prosodic feature A7 and the low-level linguistic feature A1 based on the hidden Markov model.

The prosodic structure analysis device 108 comprises the hierarchical prosodic module 102 and the prosodic structure analysis unit 103, and takes advantage of the prosodic structure analysis unit 103 while using the hierarchical prosodic module 102 to represent the prosodic feature A3 of the speech input by prosodic structures in terms of prosodic tags A4.

The prosodic feature synthesizer device 109 comprises the hierarchical prosodic module 102 and the prosodic feature synthesizer unit 106, and takes advantages of the prosodic feature synthesizer unit 106, while using the hierarchical prosodic module 102 as side information provider, to generate a second prosodic feature A7 using inputs of the second prosodic tag A6 and the low-level linguistic feature A1 reconstructed by the decoder 105.

The prosodic message encoding device 110 comprises the speech segmentation and prosodic feature extractor 101, the hierarchical prosodic module 102, the prosodic structure analysis unit 103, the encoder 104 and the prosodic structure analysis device 108. The prosodic message encoding device 110 firstly uses the speech segmentation and prosodic feature extractor 101 to segment the input speech by the low-level linguistic feature A1 and to obtain a first prosodic feature A3. Then the prosodic structure analysis device 108 generates a first prosodic tag A4 based on the first prosodic feature A3, the low-level linguistic feature A1 and a high-level linguistic feature A2. The encoder 104 then forms a code stream A5 based on the first prosodic tag A4 and the low-level linguistic feature A1.

The prosodic message decoding device 111 comprises the hierarchical prosodic module 102, the decoder 105, the prosodic feature synthesizer unit 106, the speech synthesizer 107 and the prosodic feature synthesizer device 109. The decoder 105 decodes the code stream A5, generated from the prosodic message encoding device 110, to reconstruct a second prosodic tag A6 and the low-level linguistic feature A1, which are used to synthesize a second prosodic feature A7 by the prosodic feature synthesizer device 109. The second prosodic feature A7 is then used to generate the output speech by the speech synthesizer 107.

The equations set forth hereinafter are for introducing some preferred embodiments according to the present invention. The following equation is employed by the prosodic structure analysis unit 103 for representing the speech prosody by prosodic structures in terms of prosodic tags. The method is to input the prosodic acoustic feature sequence (A) and the linguistic feature sequence (L) into the prosodic structure analysis unit 103, which may output the best prosodic tag sequence (T). The best prosodic tag sequence (T) can be used for representing the prosodic features of the speech and then for later encoding. The corresponding mathematical equation is:

$$\begin{aligned} T^* &= \{B^*, P^*\} = \underset{T}{\operatorname{argmax}}\, P(T|A, L) = \underset{T}{\operatorname{argmax}}\, P(T, A|L) \\ &= \underset{T}{\operatorname{argmax}}\, P(A|T, L)P(T|L) \\ &= \underset{B,P}{\operatorname{argmax}}\, P(X, Y, Z|B, P, L)P(B, P, |L) \\ &\approx \underset{B,P}{\operatorname{argmax}}\, \underbrace{P(X|B, P, L)P(Y, Z|B, L)P(P|B)P(B|L)}_{\text{Hierarchical Prosodic Model}} \end{aligned}$$

wherein $A=\{X,Y,Z\}=\{A_1^N\}=\{X_1^N,Y_1^N,Z_1^N\}$ is the prosodic acoustic feature sequence, N is the number of syllables in the speech, and X, Y and Z denote syllable-based prosodic acoustic feature, inter-syllable prosodic acoustic feature and differential prosodic acoustic feature, respectively. $L=\{POS,PM,WL,t,s,f\}=\{L_1^N\}=\{POS_1^N,PM_1^N,WL_1^N,t_1^N,s_1^N,f_1^N\}$ is a linguistic feature sequence, wherein {POS, PM, WL} is a high-level linguistic sequence, POS, PM and WL denote part-of-speech sequence, punctuation mark sequence and word length sequence respectively, {t,s,f} is a low-level linguistic feature sequence, and the letters t, s and f denote tone, base-syllable type and syllable final type, respectively. $T=\{B,P\}$ is a prosodic tag sequence, where $B=\{B_1^N\}$ is a prosodic break sequence, $P=\{p,q,r\}$ a prosodic state sequence, and the letters p, q and r denote syllable pitch prosodic state sequence, syllable duration prosodic state sequence and syllable energy prosodic state sequence, respectively.

Figure 2:
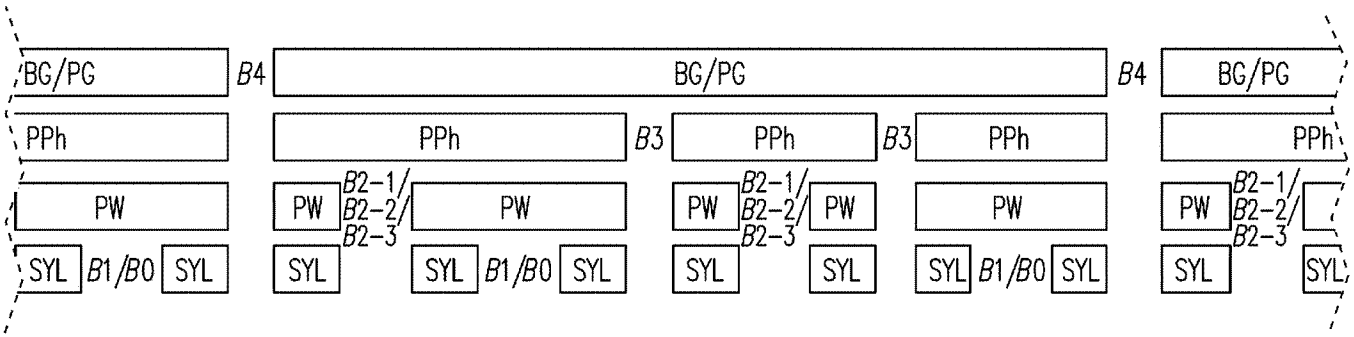
FIG. 2 is a schematic diagram showing a Mandarin Chinese speech hierarchical prosodic structure according to one embodiment of the present invention.

The prosodic tag sequence is to describe the Mandarin Chinese prosodic hierarchical structure concerned by the hierarchical prosodic module 102. Referring to FIG. 2, the structure includes 4 types of prosodic constituents: syllable (SYL), prosodic word (PW), prosodic phrase (PPh), and breath group or prosodic phrase group (BG/PG). The prosodic break $B_n$, where the subscript n denotes syllable index, is to describe the break type between the syllable n and the syllable n+1. There are totally seven prosodic break types for describing the boundary of the 4 types of prosodic constituents. The other prosodic tag P is the prosodic state denoted as $P=\{p,q,r\}$ and represents an aggregated effect on syllable prosodic acoustic feature resulted from the upper-level prosodic constituents of PW, PPh and BG/PG.

Hierarchical Prosodic Module $$P(X|B,P,L)P(Y,Z|B,L)P(P|B)P(B|L)$$

For realizing the hierarchical prosodic module, more details are described. The model has 4 sub-models, which are syllable prosodic-acoustic model P(X|B,P,L), syllable juncture prosodic-acoustic model P(Y,Z|B,L), prosodic state model P(P|B) and break-syntax model P(B|L).

The syllable prosodic-acoustic model P(X|B,P,L) can be approximated with the following sub-models:

$$\begin{aligned} P(X|B, P, L) &\approx P(sp|B, p, t)P(sd|B, q, t, s)P(se|B, r, t, f) \\ &\approx \prod_{n=1}^{N} P(sp_n|B_{n-1}^{n}, p_n, t_{n-1}^{n+1})P(sd_n|q_n, s_n, t_n) \\ &\quad P(se_n|r_n, f_n, t_n) \end{aligned}$$

Wherein the $P(sp_n|B_{n-1}^{n},p_n,t_{n-1}^{n+1})$, $P(sd_n|q_n,s_n,t_n)$ and $P(se_n|r_n,f_n,t_n)$ respectively denote the pitch contour model, the duration model and the energy level model of the n-th syllable, the reference characters $t_n$, $s_n$ and $f_n$ respectively denote the tone, the base-syllable and final types of the n-th syllable, while $B_{n-1}^{n}=(B_{n-1},B_n)$ and $t_{n-1}^{n+1}=(t_{n-1},t_n,t_{n+1})$ respectively denote the prosodic break sequence and the tone sequence.

In this embodiment, the three sub-models take more factors into account. Those factors are combined by means of superimposing. Taking the pitch contour of the n-th syllable for example, one may obtain the formula:

$$sp_n=sp_n^r+\beta_{t_n}+\beta_{p_n}+\beta_{B_{n-1},tp_{n-1}}+\beta_{B_n,tp_n}^b+\mu_{sp}$$

where $sp_n=[\alpha_{0,n},\alpha_{1,n},\alpha_{2,n},\alpha_{3,n}]$ is a four-dimensional vector for representing the pitch contour observed from the n-th syllable. The coefficients can be derived from:

$$\alpha_{j,n}=\frac{1}{M_n+1}\sum_{i=0}^{M_n}F_n(i)\cdot\phi_j\left(\frac{i}{M_n}\right)\quad j=0\sim 3$$

Where $F_n(i)$ is the i-th frame pitch of the n-th syllable, $M_n+1$ the number of frames of the n-th syllable having pitch, and $$\phi_j\left(\frac{i}{M_n}\right)$$

the j-th orthogonal basis.

$sp_n^r$ is the modeling residual of $sp_n$. $\beta_{t_n}$ and $\beta_{p_n}$ are affecting factors of tone and prosodic state, respectively. $\beta_{B_{n-1},tp_{n-1}}^f$ and $\beta_{B_n,tp_n}^b$ are forward coarticulation affecting factor and backward coarticulation affecting factor respectively. $\mu_{sp}$ is the global mean of the pitch vector. Assuming $sp_n^r$ is zero-mean and normal distributed, we may express the data with Gaussian distribution:

$$P(sp_n|B_{n-1}^n,p_n,t_{n-1}^{n+1})=N(sp_n;\beta_{t_n}+\beta_{p_n}+\beta_{B_{n-1},tp_{n-1}}^f+\beta_{B_n,tp_n}^b+\mu_{sp},R_{sp})$$

It is noted that $sp_n^r$ is a noise-like residual signal of very small deviation so that one can model the data with a normal distribution. Likewise, the syllable duration model $P(sd_n|q_n,s_n,t_n)$ and the syllable energy level model $P(se_n|r_n,f_n,t_n)$ can be expressed as follows:

$$P(sd_n|q_n,s_n,t_n)=N(sd_n;\gamma_{t_n}+\gamma_{s_n}+\gamma_{q_n}+\mu_{sd},R_{sd})$$

$$P(se_n|r_n,f_n,t_n)=N(se_n;\omega_{t_n}+\omega_{f_n}+\omega_{r_n}+\mu_{se},R_{se})$$

Where $sd_n$ and $se_n$ are the observed duration and energy level of the n-th syllable respectively, and $\gamma_x$ and $\omega_x$ respectively represent affecting factors of syllable duration and syllable energy level with the factor x.

The syllable-juncture prosodic-acoustic model P(Y,Z|B,L) describes the inter-syllable acoustic characteristics specified for different break type and surrounding linguistic features, and can be approximated with the following 5 sub-models:

$$P(Y,Z|B,L)\approx P(pd,ed,pj,dl,df|B,L)$$

$$\approx\prod_{n=1}^{N-1}P(pd_n,ed_n,pj_n,dl_n,df_n|B,L)$$

$$\approx\prod_{n=1}^{N-1}\{g(pd_n;\alpha_{B_n,L_n},\eta_{B_n,L_n})$$

-continued $$N(ed_n;\mu_{ed,B_n,L_n},\sigma^2_{ed,B_n,L_n})\cdot$$

$$N(pj_n;\mu_{pj,B_n,L_n},\sigma^2_{pj,B_n,L_n})$$

$$N(dl_n;\mu_{dl,B_n,L_n},\sigma^2_{dl,B_n,L_n})\cdot$$

$$N(df_n;\mu_{df,B_n,L_n},\sigma^2_{df,B_n,L_n})\}$$

The aforementioned formulas describe the pause duration $pd_n$, the energy-dip level $ed_n$, the normalized pitch jump $pj_n$, and two normalized syllable lengthening factors (i.e. $dl_n$ and $df_n$) across the n-th syllable juncture.

The prosodic state model P(P|B) is simulated by three sub-models:

$$P(P|B)=P(p|B)P(q|B)P(r|B)\approx P(p_1)P(q_1)P(r_1)\left[\prod_{n=2}^{N}P(p_n|p_{n-1},B_{n-1})P(q_n|q_{n-1},B_{n-1})P(r_n|r_{n-1},B_{n-1})\right]$$

The break-syntax model P(B|L) can be described as follows:

$$P(B|L)\approx\prod_{n=1}^{N-1}P(B_n|L_n)$$

where $P(B_n|L_n)$ is the break type model for the n-th juncture, and $L_n$ denotes the linguistic feature of the n-th syllable.

The probability can be estimated by many methods. The present embodiment uses the method of decision tree algorithm for the estimation. The method of sequential optimization algorithm is used to train the prosodic models, and the maximum likelihood criterion is used to generate prosodic tags.

Prosodic Structure Analysis Unit

The prosodic structure analysis unit is for labeling the hierarchical prosodic structure of the input speeches, that is, looking for the best prosodic tag T={B,P} based on the prosodic-acoustic feature vector sequence (A) and the linguistic feature sequence (L). The formula is:

$$T^*=\{B^*,P^*\}=\underset{B,P}{\operatorname{argmax}}\,Q$$

Where $Q=P(B|L)P(P|B)P(X|B,P,L)P(Y,Z|B,L)$.

The methods used by the prosodic structure analysis unit can be realized by obtaining the best solution through the iterative method set forth below:

(1) Initialization: For i=0, the best prosodic break type sequence can be found by:

$$B^i=\underset{B}{\operatorname{argmax}}\,P(Y,Z|B,L)P(B|L)$$

(2) Iteration: Obtaining the prosodic break type sequence and the prosodic state sequence by iterating the following three steps:

Step 1: Given with $B^{i-1}$, re-labeling the prosodic state sequence of each utterance by the Viterbi algorithm so as to maximize the value of Q:

$$P^i = \underset{P}{\operatorname{argmax}}\, P(X|B^{i-1}, P, L)P(Y, Z|B^{i-1}, L)P(P|B^{i-1})P(B^{i-1}|L)$$

Step 2: Given with $P^i$, re-labeling the break type sequence of each utterance by the Viterbi algorism so as to maximize the value of Q:

$$B^i = \underset{B}{\operatorname{argmax}}\, P(X|B, P^i, L)P(Y, Z|B, L)P(P^i|B)P(B|L)$$

Step 3: If a convergence of the value of Q is reached, exit the iteration process. Otherwise, increase the value of i by 1 and then go back to Step 1.

(3) Termination: Obtaining the best prosodic tag $B^*=B^i$ and $P^*=P^i$.

Coding the Prosodic Messages

It is appreciated from the hierarchical prosodic module 102 that, the syllable pitch contour $sp_n$, the syllable duration $sd_n$ and the syllable energy level $se_n$ are linear combinations concerning multiple factors, which include low-level linguistic features such as tone $t_n$, base-syllable type $s_n$ and final type $f_n$. Others are prosodic-state tags for indicating the hierarchical prosodic structure (obtained by the prosodic structure analysis unit 103): prosodic break-type tag $B_n$ and prosodic state tags $p_n$, $q_n$ and $r_n$. Thus, the syllable pitch contour $sp_n$, the syllable duration $sd_n$ and the syllable energy level $se_n$ can be obtained by simply coding and transmitting these factors. The following formulas are applied by the prosodic feature synthesizer unit 106 to reconstruct these three prosodic acoustic features by using these factors:

$$sp_n' = \beta_{t_n} + \beta_{p_n} + \beta_{B_{n-1},p_{n-1}}{}^{f} + \beta_{B_n,p_n}{}^{b} + \mu_{sp}$$

$$sd_n' = \gamma_{t_n} + \gamma_{s_n} + \gamma_{q_n} + \mu_{sd}$$

$$se_n' = \omega_{t_n} + \omega_{f_n} + \omega_{r_n} + \mu_{se}$$

Notably, the three modeling residuals, $sp_n^r$, $sd_n^r$ and $se_n^r$ may be neglected because their variance are all small. The three means, $\mu_{sp}$, $\mu_{sd}$ and $\mu_{se}$, are sent in advance to the decoder as side information.

The pause duration $pd_n$ is modeled by the syllable juncture pause duration sub-model, $g(pd_n;\alpha_{B_n,L_n}, \eta_{B_n,L_n})$, which describes the variation of syllable juncture pause duration $pd_n$ influenced by some contextual linguistic features and break type, and is organized into 7 break type-dependent decision trees (BDTs). For each break type, a decision tree is used to determine the probability density function (pdf) of syllable juncture pause duration according to the contextual linguistic features. Here, all pdfs are assumed to be Gamma distributed. In this coding scheme, all parameters of the sub-model are trained in advance and sent to the decoder as side information. In the encoder 104, the break type of the current syllable juncture and the leaf node in the corresponding decision tree that the syllable juncture resides are determined by the prosody analysis operation. Only the two symbols, i.e., the break type and the leaf-node index, are needed to be encoded and sent to the decoder 105. The decoder 105 reconstructs the syllable-juncture pause duration as the mean of the pdf of the leaf node it resides. Those distributions are considered as the side information used for transmitting information relevant to pause duration between syllables. Thus, the pause duration between syllables can be shown by merely the leaf-node index and prosodic break types $B_n$. Notably, the leaf-node index corresponding to each syllable can be obtained from the prosodic structure analysis unit 103, while the syllable-juncture pause duration can be reconstructed by looking up the BDT for the corresponding value of $\beta_{T_q}{}^{pd}$, based on the leaf-node index and prosodic break type information in the prosodic feature synthesizer unit 106.

In summary, the symbols needed to be encoded by the encoder 104 include: tone $t_n$ base-syllable type $s_n$, final type $f_n$, break type tag $B_n$, three prosodic-state tags $(p_n,q_n,r_n)$ and the index of the occupied leaf node $T_n$ in the corresponding BDT. The encoder 104 encodes with different bit length based on the aforementioned types of symbols, and eventually composes bit streams which will be sent to the decoder 105 to decode and then transmitted to the prosodic feature synthesizer unit 106 to be reconstructed to prosodic messages for speech synthesis by the speech synthesizer 107. Aside from bit steams, some features of the hierarchical prosodic module 102 are regarded as side information, which is for the use of restoring prosodic features and includes the affecting patterns (APs) $\{\beta_t, \beta_p, \beta_{B,tp}{}^{f}, \beta_{B,tp}{}^{b}, \mu_{sp})\}$ of the syllable pitch-contour sub-model, the APs $\{\gamma_t, \gamma_s, \gamma_s, \mu_{sd}\}$ of the syllable duration sub-model, the APs $\{\omega_t, \omega_f, \omega_r, \mu_{se}\}$ of the syllable energy level sub-model and the means $\{\mu_{T_n}{}^{pd}\}$ of the leaf-node pdfs of the syllable juncture pause duration sub-model.

Speech Synthesis

The task of the speech synthesizer 107 is to synthesize speech with HMM-based speech synthesis technology based on the base-syllable type, the syllable pitch contour, the syllable duration, the syllable energy level and the pause duration between syllables. The HMM-based speech synthesis is a technology known to the skilled person in the art.

Figure 3:
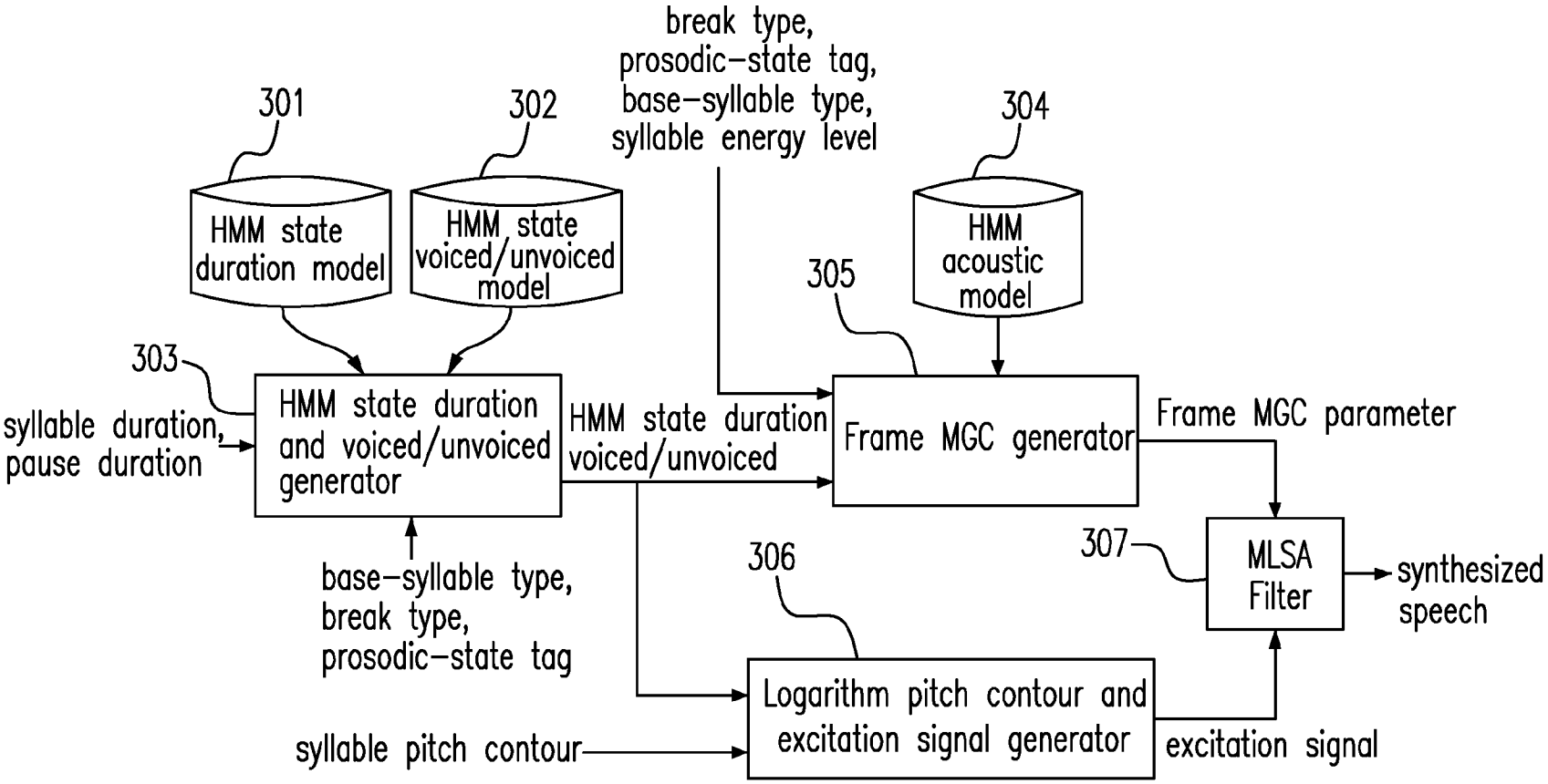
FIG. 3 shows a flow chart of utilizing a HMM-based speech synthesizer to generate the synthesized speech according to one embodiment of the present invention.

FIG. 3 shows a schematic diagram of generating a synthesized speech with an HMM-based speech synthesizer. Firstly, the state durations for each syllable segment are generated by the HMM state duration and voiced/unvoiced generator 303 with HMM state duration model 301:

$$d_{n,c} = \mu_{n,c} + \rho \cdot \sigma_{n,c}{}^2 \text{ for } c=1\sim C,\ n \text{ and } c \text{ are integers}$$

Wherein $\mu_{n,c}$ and $\sigma_{n,c}{}^2$ represent correspondingly the mean and the variance of the Gaussian model for the c-th HMM state of the n-th syllable. ρ is an elongation coefficient, which can be obtained from the following formula:

$$\rho = \left(sd_n' - \sum_{c=1}^{C} \mu_{n,c}\right) \Big/ \left(\sum_{c=1}^{C} \sigma_{n,c}^2\right)$$

Notably, the factor $sd_n'$ denotes the syllable duration reconstructed by the prosodic feature synthesizer unit 106. Since the voiced/unvoiced state of each HMM state is determined, the HMM state voiced/unvoiced model 302 and the HMM state duration model 301 together can be used to obtain the duration of voiced sound within a syllable, that is, the number of frames $M_n'+1$. Further, contours of the syllable pitch can be reconstructed at the logarithm pitch contour and excitation signal generator 306 based on the following formula:

$$F_n'(i) = \sum_{j=0}^{3} \alpha_{j,n}' \cdot \phi_j\left(\frac{i}{M_n'}\right) \text{ for } i = 0 \sim M_n'$$

Wherein $\alpha_{j,n}'$ denotes the j-th dimension of the syllable pitch contour vector reconstructed by the prosodic feature synthesizer unit 106, i.e.:

$$sp_n'=[\alpha_{0,n}',\alpha_{1,n}',\alpha_{2,n}',\alpha_{3,n}']$$

Afterwards, the excitation signal required by the MLSA synthesis filter 307 can be generated from the reconstructed logarithm pitch contour. On the other hand, each of the frame spectrum information is the MGC parameter for each frame generated by the frame MGC generator 305 using the HMM acoustic model 304 given HMM state duration, voiced/unvoiced information, break type, prosodic-state tag, base-syllable type and syllable energy level. Energy level of each of the syllable is adjusted to the level reconstructed by the prosodic feature synthesizer unit 106. Finally, the excitation signal and the MGC parameters of each frame are input into the MLSA filter 307 so as be able to synthesize speeches.

Experimental Results

Table 1 shows important statistical information of experimental corpus, which includes two major portions: (1) Single speaker Treebank corpus; and (2) Multiple speaker Mandarin Chinese continuous speech database TCC300, which are respectively for evaluating the coding performance of the speaker-dependent and the speaker-independent embodiments of on-site testing as illustrated in FIG. 1.

TABLE 1

| Corpus | Subset | Usage | No. of Speaker | No. of Utterance | No. of Syllable | Length (Hour) |
|---|---|---|---|---|---|---|
| Treebank | TrainTB | Training of the hierarchical prosodic module, the acoustic model for forced-alignment and the models for HMM-based speech synthesizer | 1 | 376 | 51,868 | 3.9 |
| | TestTB | Evaluation of prosodic coding | 1 | 44 | 3,898 | 0.3 |
| TCC300 | TrainTC1 | Training of acoustic models for forced-alignment | 274 | 8,036 | 300,728 | 23.9 |
| | TrainTC2 | Training hierarchical prosodic module | 164 | 962 | 106,955 | 8.3 |
| | TestTC | Evaluation of prosodic coding | 19 | 226 | 26,357 | 2.4 |

Table 2 shows the codeword length required by each encoding symbol

TABLE 2

| Symbol | Symbol Count | Bit Count |
|---|---|---|
| Tone $t_n$ | 5 | 3 |
| Base-syllable type $s_n$ | 411 | 9 |
| Syllable Pitch Prosodic State $p_n$ | 16 | 4 |
| Syllable Duration Prosodic State $q_n$ | 16 | 4 |
| Syllable Energy Prosodic State $r_n$ | 16 | 4 |
| Prosodic Pause $B_n$ | 7 | 3 |
| BDT Leaf Node B0/1/2-1/2-2/2-3/3/4 | 5/7/3/2/4/3/1(SI) 3/9/3/9/5/11/9(SD) | 3/3/2/1/2/2/0(SI) 2/4/2/4/3/4/4(SD) |
| Total Bit Count of Each Syllable (Maximum) | | 30 (SI) 31(SD) |

Table 3 displays the parameter count for the side information.

TABLE 3

| Type of Parameters | Parameter Count |
|---|---|
| Tone Affecting Parameters $\beta_t/\gamma_t/\omega_t$ | 20/5/5 |
| Forward and Backward Coarticulation Affecting Parameters $\beta_{B,sp}^{f}/\beta_{B,sp}^{b}$ | 720/720 |
| Prosodic State Affecting Parameters $\beta_p/\gamma_q/\omega_r$ | 16/16/16 |
| Average of Whole Corpus $\mu_{sp}/\mu_{sd}/\mu_{se}$ | 1/1/1 |
| Base-Syllable Type and Syllable final Type Affecting Parameters $\gamma_s/\omega_{fn}$ | 411/40 |
| Average BDT Leaf Node Pause Duration $\mu_{Tn}^{pd}$ | 25 (SI)/49 (SD) |
| Total | 1997 (SI)/2021 (SD) |

Table 4 shows the root-mean-square errors (RMSE) of the prosodic features reconstructed by the prosodic feature synthesizer unit 106. It is appreciated from Table 4 that those errors are relatively small.

TABLE 4

| | | Syllable Pitch contour (Hz/semitone) | Syllable Duration (ms) | Syllable Energy Level (dB) | Pause Duration (ms) |
|---|---|---|---|---|---|
| Treebank | TrainTB | 16.2/1.42 | 4.81 | 0.68 | 38.7 |
| | TestTB | 15.7/1.22 | 4.74 | 0.70 | 30.9 |
| TCC300 | TrainTC2 | 12.1/1.26 | 8.54 | 1.05 | 46.9 |
| | TestTC | 11.7/1.13 | 12.49 | 1.86 | 63.0 |

Figure 4A:
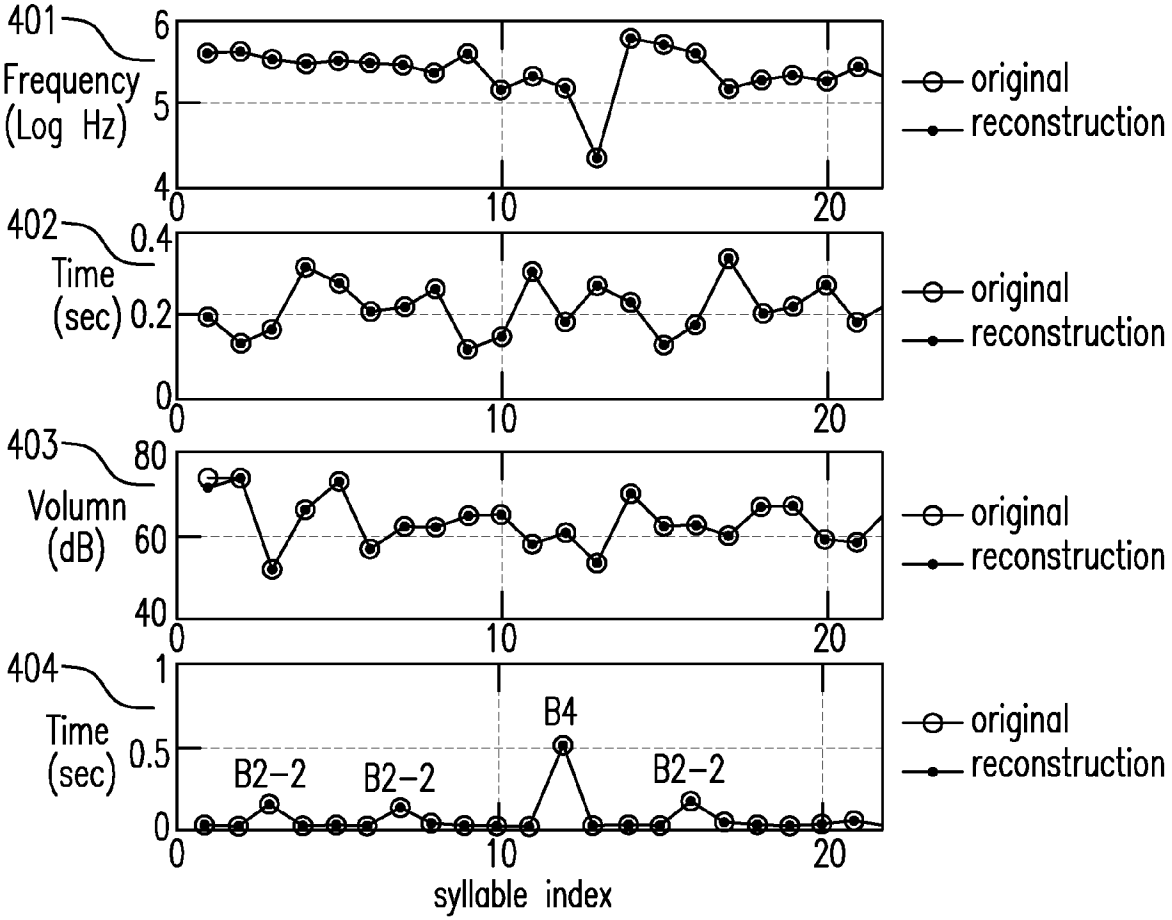
FIGS. 4A-4B are schematic diagrams showing examples of prosodic features, including speaker dependent, speaker independent original, encoded and reconstructed after being encoded, according to one embodiment of the present invention.
Figure 4B:
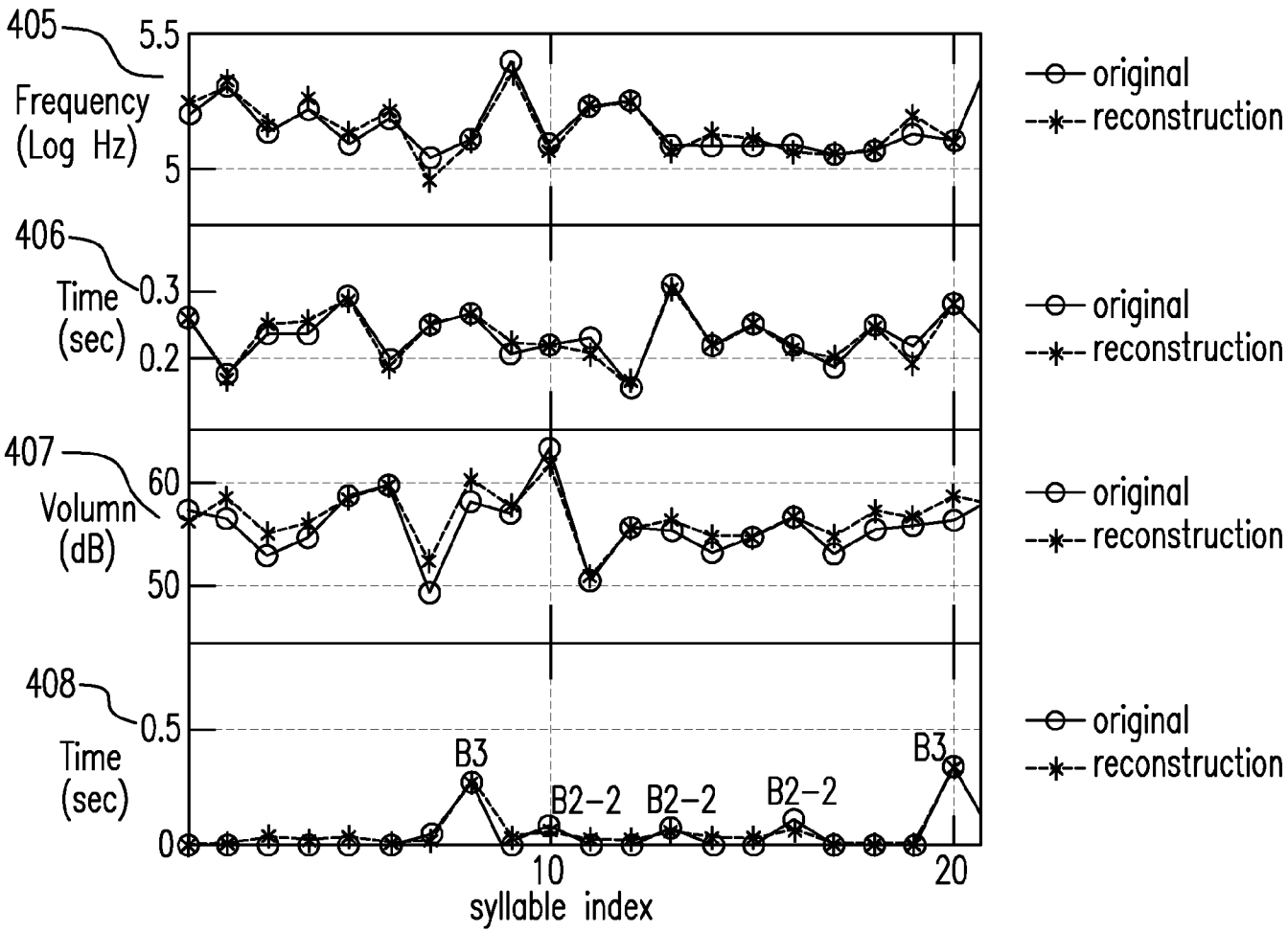

Table 5 shows the bit rate performance of the present invention. The average of speaker-dependent and speaker-independent transmission bit rates are 114.9±4.78 bits per second and 114.9±14.9 bits per second respectively, both are very low. FIGS. 4A and 4B illustrate examples of speaker-dependent (401, 402, 403 and 404) and speaker-independent (405, 406, 407 and 408) prosodic features respectively, including original and reconstruction ones. Those features includes speaker-dependent syllable pitch level 401, syllable duration 402, syllable energy level 403 and syllable juncture pause duration 404 (without B0 and B1 for conciseness) and speaker-independent syllable pitch level 405, syllable duration 406, syllable energy level 407 and syllable-juncture pause duration 408. According to FIGS. 4A and 4B, it is appreciated that the reconstructed prosodic features are very close to the original prosodic features.

TABLE 5

| | | Average ± Std. Deviation | Maximum | Minimum |
|---|---|---|---|---|
| Treebank | Train TB | 116 ± 5.25 | 131.5 | 91.5 |
| | Test TB | 114.9 ± 4.78 | 124.1 | 99.1 |
| TCC300 | Train TC2 | 113.3 ± 9.2 | 138.0 | 66.1 |
| | Test TC | 114.9 ± 14.9 | 158.8 | 84.7 |

Examples of Speech Rate Conversion

Figure 5A:
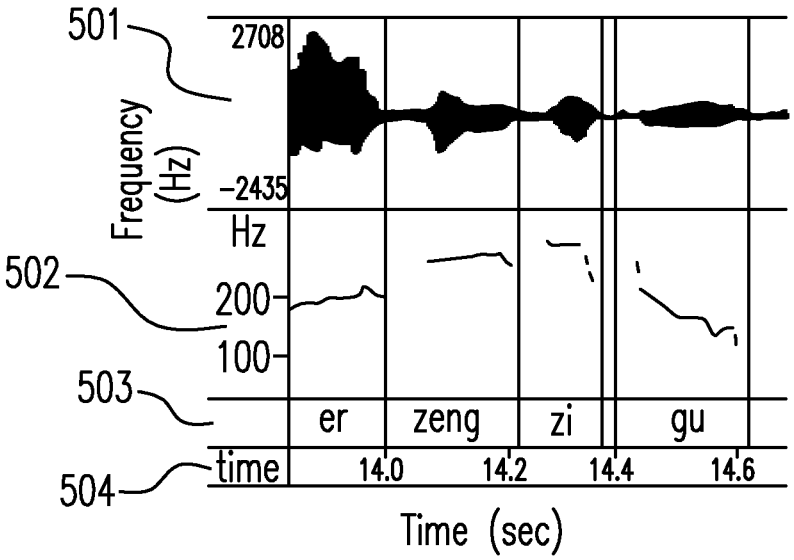
FIGS. 5A-5D are schematic diagrams showing differences between the waveforms and pitch contours of speeches of different speed synthesized and transformed after encoding the original speech and prosodic information according to one embodiment of the present invention.
Figure 5B:
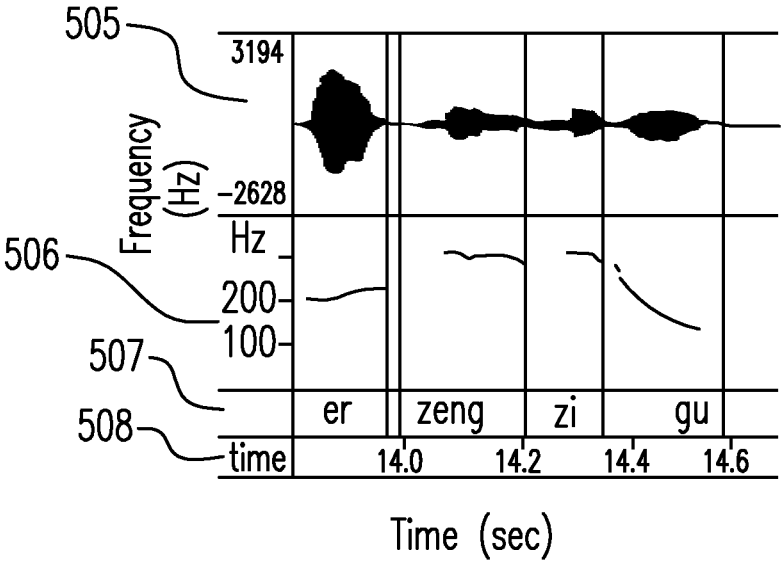
Figure 5C:
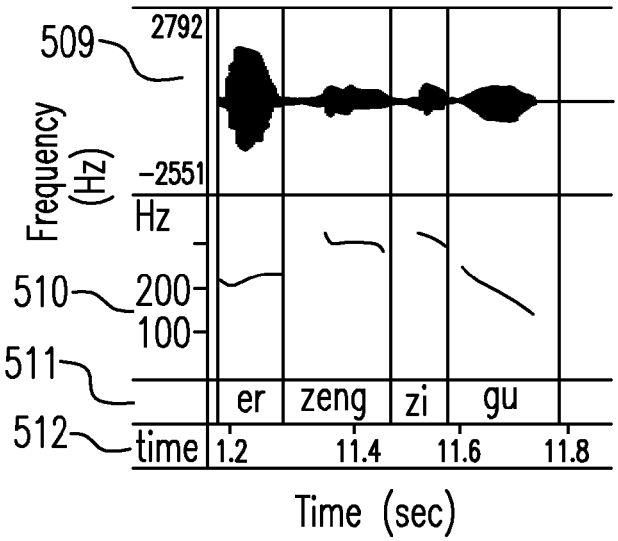
Figure 5D:
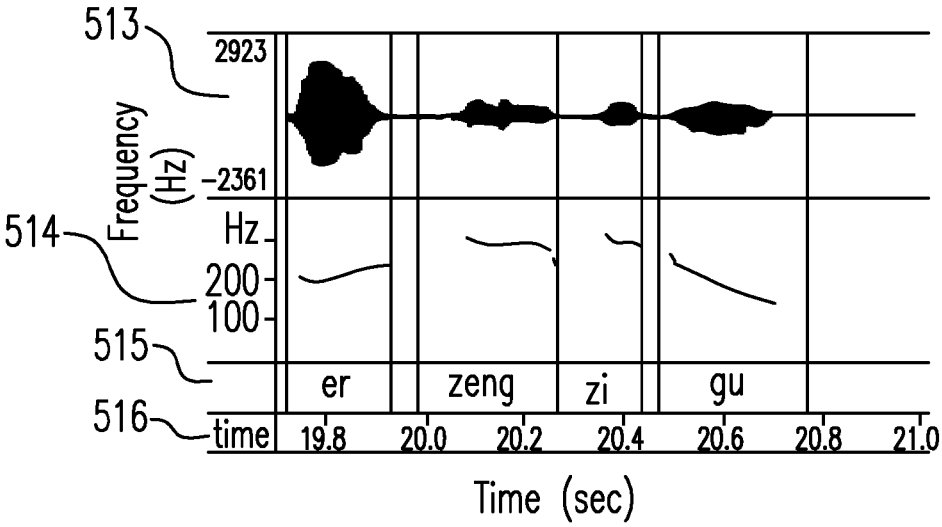

The prosodic encoding method according to the present invention also provides systematic speech rate conversion platform. The method includes replacing the hierarchical prosodic module 102 having the original speech rate with another hierarchical prosodic module 102 having a target speech rate by the prosodic feature synthesizer unit 106. The statistic data relevant to the training corpus for on-site testing are shown in Table 6. The speaker-dependent training corpus for the experimental test is recorded in a normal speed. Based on the corpus with the normal speed, the other corpus of different speech rate are the fast speed corpus and the slow speed corpus, whose corresponding hierarchical prosodic modules can be constructed by the training method the same as that for normal speed ones. FIG. 5A illustrates waveform 501 and pitch contour 502 of original speech. FIG. 5B illustrates waveform 505 and pitch contour 506 of prosodic information after encoding and synthesizing. FIG. 5C illustrates waveform 509 and pitch contour 510 of speeches whose speed is converted to a faster rate. FIG. 5D illustrates waveform 513 and pitch contour 514 of speeches whose speed is converted to a slower rate. The straight line portions in FIGS. 5A-5D indicates the position of syllable segmentation (can be shown as Mandarin Chinese pronunciation 503, 507, 511 and 515) and syllable segmentation time information 504, 508, 512 and 516. According to FIGS. 5A-5D, it is appreciated that there are significant differences in syllable duration and pause duration among the normal speed, faster speed and lower speed speeches. When the synthesized speech with different speech speed is listened by informal audio experiment, the prosody seems fluent and natural.

TABLE 6

| Corpus | No. of Utterance | Syllable Count | Length (Hour) | Articulation Rate = (Syllable Count)/(Total Syllable Duration in Second) | Speech Rate = (Syllable Count)/(Total Length of Utterances in Second) |
|---|---|---|---|---|---|
| FastTB | 368 | 50,691 | 3.4 | 5.52 | 4.40 |
| TrainTB | 376 | 51,868 | 3.9 | 5.05 | 3.82 |
| TestTB | 44 | 3,895 | 0.3 | 4.89 | 3.78 |
| SlowTB | 372 | 51231 | 6.0 | 3.78 | 2.46 |

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

Embodiments

1. A speech-synthesizing device, comprising:

a hierarchical prosodic module generating at least a first hierarchical prosodic model;

a prosody-analyzing device, receiving a low-level linguistic feature, a high-level linguistic feature and a first prosodic feature, and generating at least a prosodic tag based on the low-level linguistic feature, the high-level linguistic feature, the first prosodic feature and the first hierarchical prosodic model; and a prosody-synthesizing unit synthesizing a second prosodic feature based on the hierarchical prosodic module, the low-level linguistic feature and the prosodic tag.

2. A speech-synthesizing device of Embodiment 1, further comprising:

a prosodic feature extractor receiving a speech input and the low-level linguistic feature, segmenting the input speech to form a segmented speech, and generating the first prosodic feature based on the low-level linguistic feature and the segmented speech.

3. A speech-synthesizing device of Embodiment 2 further comprising a prosody-synthesizing device, wherein the first hierarchical prosodic model is generated based on a first speech speed, on a condition that when the prosody-synthesizing device is going to generate a second speech speed being different from the first speech speed, the first hierarchical prosodic model is replaced with a second hierarchical prosodic model having the second speech speed and the prosody-synthesizing unit changes the second prosodic feature to a third prosodic feature.

4. A speech-synthesizing device of Embodiment 3, wherein the speech-synthesizing device generates a speech synthesis with the second synthesized speech based on the third prosodic feature and the low-level linguistic feature.

5. A speech-synthesizing device of Embodiment 1, further comprising:

an encoder receiving the prosodic tag and the low-level linguistic feature to generate a code stream; and a decoder receiving the code stream, and restoring the prosodic tag and the low-level linguistic feature.

6. A speech-synthesizing device of Embodiment 5, wherein the encoder includes a first codebook providing an encoding bit corresponding to the prosodic tag and the low-level linguistic feature so as to generate the code stream, and the decoder includes a second codebook providing the encoding bit to reconstruct code stream to the prosodic tag and the low-level linguistic feature.

7. A speech-synthesizing device of Embodiment 5, further comprising:

a prosody-synthesizing device receiving the prosodic tag and the low-level linguistic feature reconstructed by the decoder to generate the second prosodic feature including a syllable pitch contour, a syllable duration, a syllable energy level and an inter-syllable pause duration.

8. A speech-synthesizing device of Embodiment 7, wherein the second prosodic feature is reconstructed by a superposition module.

9. A speech-synthesizing device of Embodiment 7, wherein the syllable juncture pause duration is reconstructed by looking up a codebook.

10. A prosodic information encoding apparatus, comprising:

a speech segmentation and prosodic feature extracting device receiving a speech input and a low-level linguistic feature to generate a first prosodic feature;

a prosodic structure analysis unit receiving the first prosodic feature, the low-level linguistic feature and a high-level linguistic feature, and generating a prosodic tag based on the first prosodic feature, the low-level linguistic feature and the high-level linguistic feature; and an encoder receiving the prosodic tag and the low-level linguistic feature to generate a code stream.

11. A code stream generating apparatus, comprising:

a prosodic feature extractor generating a first prosodic feature;

a hierarchical prosodic module providing a prosodic structure meaning for the first prosodic feature; and an encoder generating a code stream based on the first prosodic feature having the prosodic structure meaning, wherein the hierarchical prosodic module has at least two parameters being ones selected from the group consisting of a syllable duration, a pitch contour, a pause timing, a pause frequency, a pause duration and a combination thereof.

12. A method for synthesizing a speech, comprising steps of:

providing a hierarchical prosodic module, a low-level linguistic feature, a high-level linguistic feature and a first prosodic feature;

generating at least a prosodic tag based on the low-level linguistic feature, the high-level linguistic feature, the first prosodic feature and the hierarchical prosodic module; and outputting the speech according to the prosodic tag.

13. A method of Embodiment 12, further comprising steps of:

providing an inputting speech;

segmenting the inputting speech to generate a segmented input speech;

extracting a prosodic feature from the segmented input speech according to the low-level linguistic feature to generate the first prosodic feature;

analyzing the first prosodic feature to generate the prosodic tag;

encoding the prosodic tag to form a code stream;

decoding the code stream;

synthesizing a second prosodic feature based on the low-level linguistic feature and the prosodic tag; and outputting the speech based on the low-level linguistic feature and the second prosodic feature.

14. A prosodic structure analysis unit, comprising:

a first input terminal receiving a first prosodic feature;

a second input terminal receiving a low-level linguistic feature;

a third input terminal receiving a high-level linguistic feature; and an output terminal, wherein the prosodic structure analysis unit generates a prosodic tag at the output terminal based on the first prosodic feature, the low-level and the high-level linguistic features.

15. A speech-synthesizing device, comprising:

a decoder receiving a code stream and restoring the code stream to generate a low-level linguistic feature and a prosodic tag;

a hierarchical prosodic module receiving the low-level linguistic feature and the prosodic tag to generate a second prosodic feature; and a speech synthesizer generating a synthesized speech based on the low-level linguistic feature and the second prosodic feature.

16. A prosodic structure analysis apparatus, comprising:

a hierarchical prosodic module generating a hierarchical prosodic model; and a prosodic structure analysis unit receiving a first prosodic feature, a low-level linguistic feature and a high-level linguistic feature, and generating a prosodic tag based on the first prosodic feature, the low-level and the high-level linguistic features and the hierarchical prosodic model.

17. A prosodic structure analysis apparatus of Embodiment 16, wherein the low-level linguistic feature includes a base-syllable type, a syllable-final type, and a tone type of a language.

18. A prosodic structure analysis apparatus of Embodiment 16, wherein the high-level linguistic feature includes a word, a part of speech and a punctuation mark.

19. A prosodic structure analysis apparatus of Embodiment 16, wherein the prosodic feature includes a syllable pitch contour, a syllable duration, a syllable energy level and a syllable juncture pause duration.

20. A prosodic structure analysis apparatus of Embodiment 16, wherein the prosodic structure analysis device performs an optimization algorithm by referring to the low-level linguistic feature and the high-level linguistic feature to generate the prosodic tag.

What is claimed is:

1. A speech-synthesizing device, comprising:

a hierarchical prosodic module generating at least a first hierarchical prosodic model;

a prosody structure analyzing device, receiving a low-level linguistic feature, a high-level linguistic feature and a first prosodic feature, and generating at least a prosodic tag based on the low-level linguistic feature, the high-level linguistic feature, the first prosodic feature and the first hierarchical prosodic model, wherein the prosodic tag includes a prosodic break sequence describing at least an inter-syllable pause duration and a prosodic state sequence defining at least a syllable pitch contour, a syllable duration and a syllable energy level, and describes a Mandarin Chinese prosodic hierarchical structure including a syllable, a prosodic word, a prosodic phrase and one of a breath group and a prosodic phrase group;

a prosody-synthesizing unit synthesizing a second prosodic feature based on the hierarchical prosodic module, the low-level linguistic feature and the prosodic tag;

a prosodic feature extractor receiving a speech input and the low-level linguistic feature, segmenting the speech input to form a segmented speech, and generating the first prosodic feature based on the low-level linguistic feature and the segmented speech; and a prosody-synthesizing device, wherein the first hierarchical prosodic model is generated based on a first speech speed, on a condition that when the prosody-synthesizing device is going to generate a second speech speed being different from the first speech speed, the first hierarchical prosodic model is replaced with a second hierarchical prosodic model having the second speech speed and the prosody-synthesizing unit changes the second prosodic feature to a third prosodic feature, and the speech-synthesizing device generates a speech synthesis based on the third prosodic feature and the low-level linguistic feature.

2. A speech-synthesizing device as claimed in claim 1, further comprising:

an encoder receiving the prosodic tag and the low-level linguistic feature to generate a code stream; and a decoder receiving the code stream, and restoring the prosodic tag and the low-level linguistic feature.

3. A speech-synthesizing device as claimed in claim 2, wherein the encoder includes a first codebook providing an encoding bit corresponding to the prosodic tag and the low-level linguistic feature so as to generate the code stream, and the decoder includes a second codebook providing the encoding bit to reconstruct code stream to the prosodic tag and the low-level linguistic feature.

4. A speech-synthesizing device as claimed in claim 2, further comprising:

a prosody-synthesizing device receiving the prosodic tag and the low-level linguistic feature reconstructed by the decoder to generate the second prosodic feature including the syllable pitch contour, the syllable duration, the syllable energy level and the inter-syllable pause duration.

5. A speech-synthesizing device as claimed in claim 4, wherein the second prosodic feature is reconstructed by a superposition module.

6. A speech-synthesizing device as claimed in claim 4, wherein the inter-syllable pause duration is reconstructed by looking up a codebook.

7. A method for synthesizing a speech, comprising steps of:

providing a hierarchical prosodic module, a low-level linguistic feature, a high-level linguistic feature and a first prosodic feature;

generating at least a prosodic tag based on the low-level linguistic feature, the high-level linguistic feature, the first prosodic feature and the hierarchical prosodic module, wherein the prosodic tag includes a prosodic break sequence describing at least an inter-syllable pause duration and a prosodic state sequence defining at least a syllable pitch contour, a syllable duration and a syllable energy level, and describes a Mandarin Chinese prosodic hierarchical structure including a syllable, a prosodic word, a prosodic phrase and one of a breath group and a prosodic phrase group; and outputting the speech according to the prosodic tag.

8. A method as claimed in claim 7, further comprising steps of:

providing an inputting speech;

segmenting the inputting speech to generate a segmented input speech;

extracting a prosodic feature from the segmented input speech according to the low-level linguistic feature to generate the first prosodic feature;

analyzing the first prosodic feature to generate the prosodic tag;

encoding the prosodic tag to form a code stream;

decoding the code stream;

synthesizing a second prosodic feature based on the low-level linguistic feature and the prosodic tag; and outputting the speech based on the low-level linguistic feature and the second prosodic feature.

* * * * *